United States Patent [19]

Ades et al.

[11] Patent Number: 4,620,086

[45] Date of Patent: Oct. 28, 1986

[54] DUAL COATED RADIANT ELECTRICAL HEATING ELEMENT

[75] Inventors: Adrian R. Ades, Schenectady; Paul B. Pribis, Saratoga; Donald J. Proach, Rotterdam, all of N.Y.

[73] Assignee: General Electric Company, Schenectady, N.Y.

[21] Appl. No.: 781,380

[22] Filed: Sep. 30, 1985

[51] Int. Cl.[4] ..... H05B 3/10; H01B 7/00; H01C 1/02; B05D 3/02

[52] U.S. Cl. ..... 219/552; 219/353; 219/354; 219/355; 219/553; 174/110 A; 174/120 C; 174/120 R; 338/245; 338/267; 338/270; 338/296; 427/34; 427/226; 427/423; 427/402; 428/377; 428/380; 428/384

[58] Field of Search ..... 219/353, 354, 355, 552, 219/553; 338/262-270, 257, 275, 245, 296, 300, 302, 304; 174/120 C, 120 R, 110 A; 428/377, 380, 384; 427/34, 226, 423, 427, 376.2, 402

[56] References Cited

U.S. PATENT DOCUMENTS

| | | | |
|---|---|---|---|
| 2,975,078 | 3/1961 | Rayfield | 428/384 |
| 3,223,553 | 12/1965 | Morexx | 174/120 R |
| 3,925,575 | 12/1975 | Church et al. | 427/226 |
| 4,417,097 | 11/1983 | Das | 174/110 A |
| 4,421,799 | 12/1983 | Novinski | 427/423 |
| 4,457,948 | 7/1984 | Ruckle et al. | 427/34 |

*Primary Examiner*—E. A. Goldberg
*Assistant Examiner*—Gerald E. Preston
*Attorney, Agent, or Firm*—Robert A. Cahill

[57] ABSTRACT

To reduce the tendency of ground faults and short circuits on electrical heating elements operating at elevated voltages and temperatures, resistance heating wire is coated with a sublayer of magnesium zirconate followed by an outer layer of aluminum oxide; each layer being in the range of 0.001 to 0.010 inches thick.

7 Claims, 2 Drawing Figures

DUAL COATED RADIANT ELECTRICAL HEATING ELEMENT

BACKGROUND OF THE INVENTION

The present invention relates to radiant electrical heaters and particularly to heating elements therefor capable of high temperature operation.

The prior art is replete with attempts to increase the operating temperature capabilities of radiant electrical heating elements applied to a wide range of applications from cathode heaters for vacuum tubes to heaters for large industrial ovens. In many of these applications, elevating the operating temperatures would provide operating efficiencies and other benefits. One radiant electrical heating application of particular interest to applicants is in large portable ovens, such as disclosed in commonly assigned, copending application Ser. No. 491,509, filed May 4, 1983, for releasing the shrink fit of the wheels on a turbine rotor shaft. In such a procedure, it is necessary to inject large quantities of heat into the hub portion of the turbine wheel quickly so that the heel hub is heated at a much faster rate than the rotor shaft. The shrink fit can thus be released in less time while reducing the amount of energy wasted in heating the rotor shaft. To achieve this, the electric heaters are disposed as close as possible to the wheel, in some cases as close as one-quarter inch, while taking care to prevent them from actually contacting the wheel. Thus radiant heat transfer is the predominant heating mode. With such close spacings and the higher voltages requisite to achieving heating element operating temperatures above 2,000 degrees Fahrenheit, spurious electrical faults have proven to be a significant problem. That is, arcing from the heating elements to the wheel reduces heating efficiency and, if allowed to persist, will destroy the heating elements, and damage the workpiece being heated.

In an effort to increase the operating temperature capabilities of electrical heating elements, one approach has been to imbed or pot the resistance wire in various insulating compounds. While providing ample electrical insulation, potting has the distinct disadvantage of introducing excessive heat transfer resistance. Another approach has been to apply insulative coatings of various compositions to the resistance heating wire. Such prior art coating attempts have universally failed to satisfy all of the requirements for ultra-high temperature operation which are, inter alia, sufficient electrical resistance to prevent ground faults, sufficiently low thermal resistance so as not to degrade heater operation, adequate tenacity so as not to spall off after repeated thermal cycling, and practical in terms of material cost and the amount of labor, time and equipment to apply the coating.

It is accordingly an object of the present invention to provide an improved radiant electrical heating element.

An additional object is to provide a radiant electrical heating element of the above-character which is capable of operating at extremely high temperatures.

Another object is to provide a radiant electrical heating element of the above-character which is adapted for highly efficient radiant heat transfer.

Yet another object is to provide a radiant electrical heating element wherein the resistance wire thereof is adequately electrically insulated such as to inhibit spurious electrical ground faults to adjacent objects, including the workpiece to be heated.

A further object is to provide a radiant electrical heating element of the above-character which is reliable and efficient in operation, capable of withstanding repeated thermal cycling over a long operating life, and economical to manufacture.

Other objects of the invention will in part be obvious and in part appear hereinafter.

SUMMARY OF THE INVENTION

In accordance with the present invention, there is provided an improved radiant electrical heating element capable of operation at extremely high temperatures of 2700 degrees Fahrenheit and above. Operation at such extreme temperatures is achieved without sacrificing heating efficiency, and spurious ground faults are virtually eliminated. Thus, the improved electrical heating elements can be safely spaced in intimate proximity to the object to be heated for maximum radiant heat transfer. More heat can thus be injected into the object in a shorter period of time to provide significant reductions in thermal processing time.

More specifically, the present invention provides a radiant electrical heating element having a dual-coated resistance wire, the coatings providing the requisite electrical insulation to inhibit electrical faults and, at the same time, a low thermal resistance to provide acceptable heating efficiency. In fact, the increased heat transfer surface area created by the presence of the coatings is found to substantially compensate for the thermal resistance introduced by the coating materials. The coatings comprise, according to the present invention, an undercoat of magnesium zirconate and an outer coating of alumina or aluminum oxide. These coatings are preferably applied in succession by a plasma arc spraying process to thicknesses ranging from 4 to 10 mils. In addition to the above-mentioned advantages afforded by the present invention, it has been found that these coatings appear to provide added mechanical strength to the resistance wire enabling its operation at temperatures in excess of 2700° F.

The invention accordingly comprises the features of construction, combination of elements and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawing, in which:

FIG. 1 is a perspective view of an industrial radiant electric heater equipped with a heating element constructed in accordance with the present invention; and FIG. 2 is a cross-sectional view of the dual-coated heating element resistance wire utilized in the heater of FIG. 1.

Corresponding reference numerals refer to like parts throughout the several views of the drawing.

DETAILED DESCRIPTION

Figure 1:
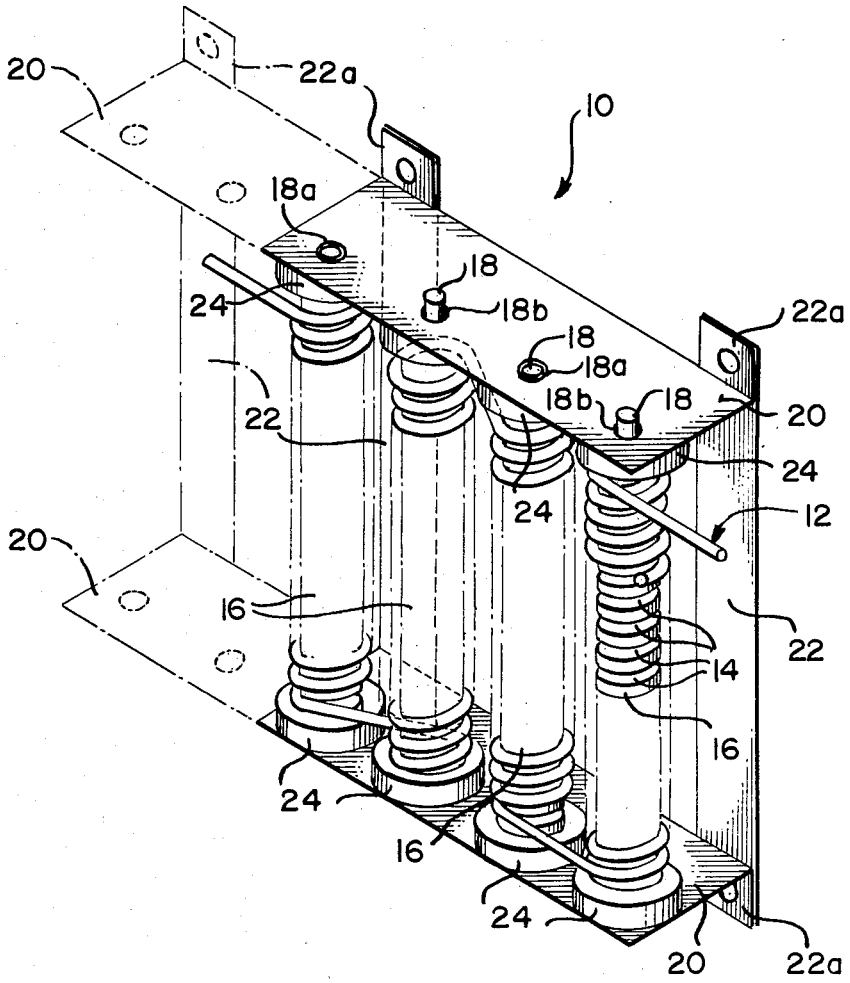

Referring to FIG. 1, a typical industrial radiant electric heater, generally indicated at 10, is shown equipped with the improved heating element of the invention, which is in the form of a continuous strand, generally indicated at 12, helically wound in spiralling grooves 14 formed in the surfaces of an array of ceramic tubes 16. Rods 18 extending through central bores (not shown) in these tubes are mounted by sheet metal end brackets 20 affixed to transverse sheet metal stringers 22 pursuant to mounting the tubes in spaced parallel relation. Outboard extensions of these stringers serve as feet 22*a* for mounting the heater in its operative position. Rods 18 are welded to end brackets 20 at one of their ends, as indicated at 18*a*, while their other ends extend through clearance holes in the end brackets, as indicated at 18*b*. This design expedient is for the purpose of accommodating thermal expansion. Ceramic washers 24 positioned between the tube ends and the brackets serve to isolate heating element 12 from the end brackets.

Figure 2:
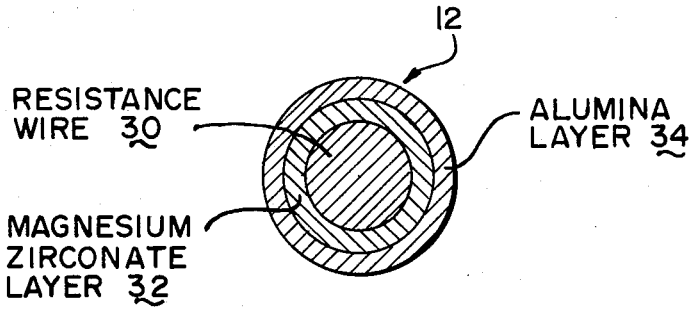

Turning to FIG. 2, heating element 12 is, in accordance with the present invention, provided having a suitable electrical resistance wire 30, coated with an inner or sub-layer 32 of magnesium zirconate and an outer layer 34 of aluminum oxide or alumina. Both coating layers are of thicknesses ranging from 4 to 10 mils. Actually, FIG. 2 is an idealize depiction of heating element 12, since these coatings are applied after the resistance wire 30 is wound on tubes 16. While it would be perhaps advantageous from a production standpoint to apply the dual coatings in advance, it is found that the coatings crack and flake off as the heating element is coiled around the tubes. Thus, the coatings are applied not only to the exposed surface of the resistance wire, but also to the exposed surfaces of the tubes, washers, brackets, and stringers of heater 10. Preferably, the coatings are applied via a plasma arc spray.

To prepare heater 10 for coating the resistance wire 30, it is degreased in a bath of trichloroethane, blasted with non-metallic grit, and the grit residue blown off with clean dry air. A suitable plasma gun, such as available from Metco, Inc. of Westbury, N.Y., is mounted on an X-Y mechanism for transversal across heater 10 at a constant velocity to ensure coating uniformity. The heater is preheated to approximately 150° F. with the plasma gun prior to the application of the magnesium zirconate coating at a spray distance of three inches using Metco parameter set No. 3. The alumina coating is then applied using Metco parameter No. 5, again at a three inch spray distance. As noted above, the coating thickness of each coat preferably ranges from 4 to 10 mils.

Tests have shown that dual coated heating elements with approximately four mil coating thicknesses have the requisite endurance to operate at the elevated temperatures indicated above without the coatings cracking or spalling and without detectable leakage currents. In comparison thermal tests of coated and uncoated heating elements, the former had to be operated at only a slightly higher voltage to achieve the same heat output, indicating that the thermal resistance of the coating materials is not of a magnitude to prejudice efficient heater operation. Thermal cycling, cold and humidity tests failed to produce any cracking, spalling or any other evidences of coating failure. Each of these tests was followed by a dielectric test, and no leakage current was detected.

The net result of all of these tests indicates that the magnesium zirconate coating adheres to the resistance wire and the alumina coating to the magnesium zirconate coating with the requisite tenacity to withstand all foreseeable heater operating conditions, while effectively eliminating the occurences of spurious electric faults which had plagued heaters with uncoated heating elements operating at temperatures lower than the ultra-high temperatures contemplated for the present invention. It is therefore apparent that the dual coated heating element of the present invention will accommodate effective ultra high temperature heater operation over a long life span.

It will thus be seen that the objects set forth above, including those made apparent in the preceding description, are efficiently attained, and, since certain changes may be made in the above construction without departing from the scope of the invention, it is intended that all matter contained in the above description or shown in the accompanying drawing shall be interpreted as illustrative and not in a limiting sense.

Having described the invention, what we claim as new and desire to secure by Letters Patent is:

1. An electrical heating element comprising, in combination:

A. a resistance wire;

B. a coating of magnesium zirconate applied to said wire; and

C. a coating of alumina applied to said magnesium zirconate coating.

2. The electrical heating element defined in claim 1, wherein said coatings are applied using a plasma arc spray.

3. The electrical heating element defined in claim 1, wherein said magnesium zirconate coating is in the range of 4 to 10 mils thick.

4. The electrical heating element defined in claim 1, wherein said alumina coating is in the range of 4 to 10 mils thick.

5. The electrical heating element defined in claim 1, wherein said coatings are each in the range of 4 to 10 mils thick.

6. The electrical heating element defined in claim 1, wherein said wire is wound on a ceramic tube prior to the application of said coatings.

7. The electrical heating element defined in claim 6, wherein said coatings are each in the range of 4 to 10 mils thick.

* * * * *